US005090616A

United States Patent [19]

Bertsch

[11] Patent Number: 5,090,616

[45] Date of Patent: Feb. 25, 1992

[54] FOLDING CARTON BLANK AND METHOD OF FORMING SAME

[75] Inventor: Raymond O. Bertsch, Chebanse, Ill.

[73] Assignee: Riverwood Natural Resources Corporation, Denver, Colo.

[21] Appl. No.: 742,254

[22] Filed: Aug. 8, 1991

Related U.S. Application Data

[62] Division of Ser. No. 613,344, Nov. 14, 1990.

[51] Int. Cl.[5] ..... B65D 5/02; B65D 5/42

[52] U.S. Cl. ..... 229/132; 229/134; 229/190

[58] Field of Search ..... 229/132, 134, 190, 198.2

[56] References Cited

U.S. PATENT DOCUMENTS

| | | | |
|---|---|---|---|
| 1,698,699 | 1/1929 | Andrews | 229/134 |
| 2,259,822 | 10/1941 | Kienlen | 229/198.2 |
| 2,317,773 | 4/1943 | Kavanaugh | 229/134 |
| 2,521,208 | 9/1950 | Eaton | 229/134 |
| 3,017,067 | 1/1962 | Parks | 229/198.2 |
| 3,061,167 | 10/1962 | Haack | 229/190 |
| 3,073,501 | 1/1963 | Williamson . | |
| 3,124,297 | 3/1964 | Vergobbi | 229/198.2 |
| 3,194,474 | 7/1965 | Runberger | 229/190 |
| 3,367,556 | 2/1968 | Whitby | 229/134 |
| 3,554,432 | 1/1971 | William . | |
| 4,250,994 | 2/1981 | Focke | 229/190 |
| 4,358,918 | 11/1982 | Groom et al. . | |
| 4,441,614 | 4/1984 | Gulliver . | |
| 4,503,659 | 3/1985 | Sherman . | |
| 4,524,564 | 6/1985 | Groom et al. . | |
| 4,676,430 | 6/1987 | Wischusen, III . | |
| 4,732,315 | 3/1988 | Gunn . | |
| 4,759,167 | 7/1988 | Langen et al. . | |
| 4,869,052 | 9/1989 | Calvert . | |
| 4,875,323 | 10/1989 | Craighead . | |
| 5,592,190 | 6/1986 | Sherman et al. . | |

OTHER PUBLICATIONS

Photograph marked Exhibit A.
Bounce fabric softner container.

*Primary Examiner*—Gary E. Elkins
*Attorney, Agent, or Firm*—John D. Lister; Cornelius P. Quinn

[57] ABSTRACT

A modified glue flap of a folding carton blank for preventing glue from being squeezed out during the step of adhering the glue flap to the opposite end panel. The face of the glue flap engaged by the glue back-up wheel includes a protrusion near the trailing edge of the flap. Engagement of the protrusion by the back-up wheel causes the glue wheel to skip the trailing area of the flap. The absence of glue in this area prevents glue from being squeezed out when sealing pressure is subsequently applied to the glue flap and the opposite end panel. The protrusion may take the form of an embossed ridge, forming a channel on the opposite side of the protrusion for receiving any excess glue which would have been squeezed out.

4 Claims, 3 Drawing Sheets

FOLDING CARTON BLANK AND METHOD OF FORMING SAME

This is a division of application Ser. No. 07/613,344 filed Nov. 14, 1990, pending.

FIELD OF THE INVENTION

This invention relates to a carton formed from a folded blank. More particularly, it relates to a carton blank and related method for preventing excess glue from being applied to the blank.

BACKGROUND OF THE INVENTION

Folding cartons used to package a variety of different products are formed in packaging machines from folded carton blanks. The folded blanks are basically in the form of collapsed sleeves formed by the carton blank manufacturer from a flat blank comprised of foldably connected panels. To form a collapsed sleeve, a glue flap connected to one of the end panels is adhered to the edge portion of the opposite end panel after the blank has been folded into proper position. In such a blank the tabs or flaps which eventually form the ends of the package are in unfolded condition extending from the leading and trailing ends of the blank as it moves through the blank forming machine.

While it is of course essential to apply a sufficient amount of glue to the glue flap to hold the carton together, it is also important not to apply so much that it squeezes out from between the glue flap and the opposite end panel during formation of the collapsed folded carton blank. When this occurs, the collapsed carton blanks may adhere to each other in the stacks in which they are shipped, and the excess glue may prevent the collapsed blanks from being opened in the final packaging operation. If collapsed blanks cannot be readily opened in the packaging machine, the blanks jam up, requiring the machine to be shut down to remove the jam. This slows the overall packaging process considerably and is to be avoided if at all possible.

Glue is conventionally applied by a glue wheel to carton blanks having only one glue line Although glue wheel application is desirable from the standpoint of assuring that sufficient amounts of glue are applied during a high speed collapsed carton blank forming operation, the difficulty in controlling the quantity applied gives rise to the problem of excessive glue application. In addition, variations in operating conditions, such as in the paperboard thickness and in the pressure applied by the press rolls used to press the glue flap and opposite end panel together, can also cause glue to be squeezed out from between the glued segments.

It would be highly advantageous to be able to better control the gluing operation to prevent the application of excessive amounts of glue. It would also be desirable to control the gluing operation in a manner which does not require extensive changes to the blank forming machine and does not require it to run slower.

SUMMARY OF THE INVENTION

A folding carton blank of the usual type is provided, wherein the blank comprises at least one interior panel section and opposite end panel sections, each panel section being connected to an adjacent panel section by a fold line. A glue flap is connected to one of the end panel sections by a fold line and is adapted to be glued to the other end panel section. In accordance with the invention, the glue flap, which is adapted to receive glue on one face from a glue wheel, is provided with a protrusion on the opposite face, along with a corresponding recess on the glue face. The protrusion and recess are located near the trailing edge of the glue flap and may take various forms, such as a protrusion which is continuous from its point of inception to the trailing edge of the glue flap, resulting in a continuous recess in the opposite glue face, or a ridge spaced from the trailing edge, resulting in a corresponding channel in the glue face.

The protrusion in this arrangement acts to push the glue wheel back-up support means away from the glue wheel to prevent the application of glue to the trailing portion of the glue flap and also to accommodate any excess glue which may have been present.

These and further details and aspects of the invention, as well as their benefits, will readily be ascertained from the more detailed description of the preferred embodiments which follows.

DETAILED DESCRIPTION OF THE PREFERRED EMBODIMENT

Figure 1:
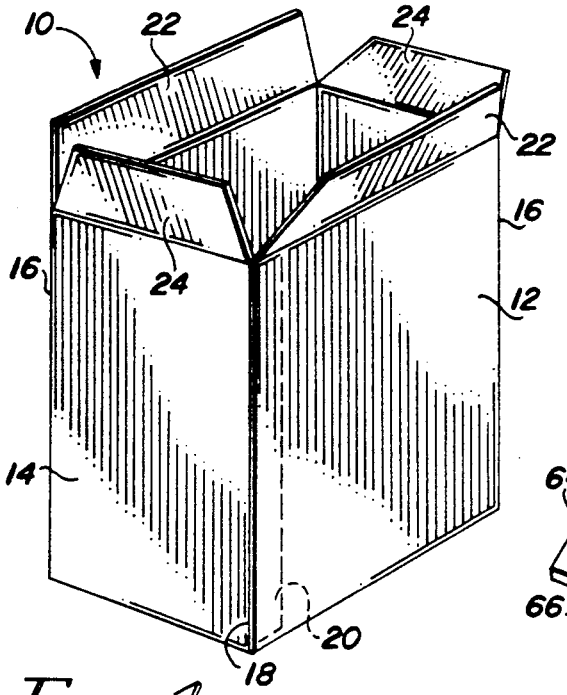
FIG. 1 is a pictorial view of a carton formed in accordance with the invention.

Referring to FIG. 1, a typical folding carton 10 comprises side panels 12, connected to end panels 14 along fold lines 16 and 18. The fold line 18 does not directly connect the panels 12 and 14, but connects panel 14 to glue flap 20, shown in dotted lines, which has been adhered to the inner surface of the panel 12. The top of the carton is shown in open condition, with closure flaps 22 and 24 foldably connected to the side and end panels. Similar flaps, not shown, are connected to the side and end panels at the other end to form the bottom panel.

Figure 2:
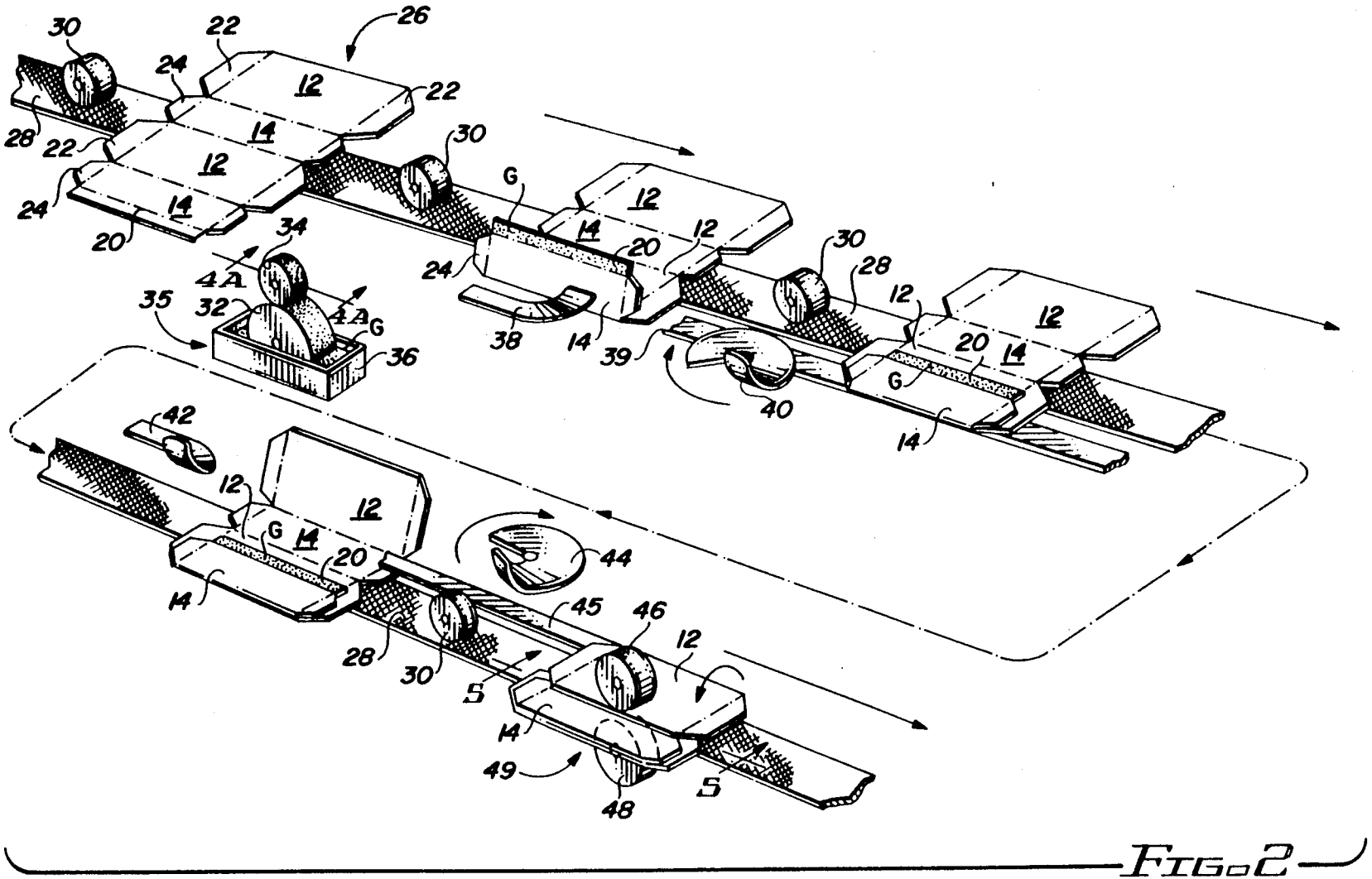
FIG. 2 is a schematic pictorial view of a portion of a carton blank forming line which may be utilized in carrying out the invention.

As shown in FIG. 2, the carton of FIG. 1 is formed from a flat blank 26 which is moved by suitable means, such as belts 28 and cooperating pressure rolls 30 through a series of stations of a collapsed carton blank forming machine. As illustrated, the glue flap 20 of the blank passes between a glue wheel 32 and back-up wheel 34 comprising a glue station 35. The lower portion of the glue wheel rotates through a glue reservoir 36, picking up glue G on the periphery of the wheel and transferring it to the underside of the glue flap.

After passing through the glue station, the end panel 14 of the moving blank is folded up by stationary plows or arms 38 and down over folding bar 39 by rotating plow 40. As a result of this folding operation, the panel section 14 now overlies the adjacent panel 12, and the attached glue flap 20 is located intermediate the edges of the panel blank, with the glue side facing up. Similarly, downstream stationary and rotating plows 42 and 44, respectively, fold the opposite side panel 12 over a folding bar 45 so that its edge portion overlies the glue flap 20. Pressure rollers 46 and 48, comprising a bonding station 49, then apply sufficient pressure to bond the glue flap to the side panel 12. It will be understood that the steps described in connection with FIG. 2 are intended to represent any suitable method for folding a blank into collapsed or sleeve form, as long as the method includes the application of glue by means of a wheel and the subsequent application of pressure to bond the glue flap to an adjacent panel. It will be appreciated that not all of the structure normally utilized in a carton blank forming machine has been shown since it was not necessary to an understanding of the invention and would tend to obscure the schematic representation of FIG. 2.

Figure 3:
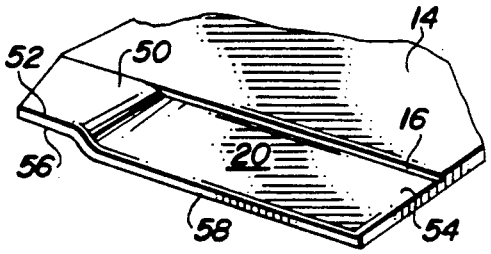
FIG. 3 is an enlarged partial pictorial view of one embodiment of the glue flap design of the present invention.

Referring now to FIG. 3, which shows the glue flap of the blank 26 in greater detail, it can be seen that the trailing edge of the glue flap 20 has been embossed out of the plane of the rest of the flap as indicated at 50. Thus the upper surface 52 of the embossed section 50 extends upwardly a greater distance than the upper surface 54 of the remainder of the flap 20, and the lower surface 56 of the embossed section extends a similar distance above the lower surface 58 of the remainder of the flap 20. It will be understood that the lower surfaces 56 and 58 of the flap form the face of the glue flap that receives glue at the glue station 35.

Figure 4A:
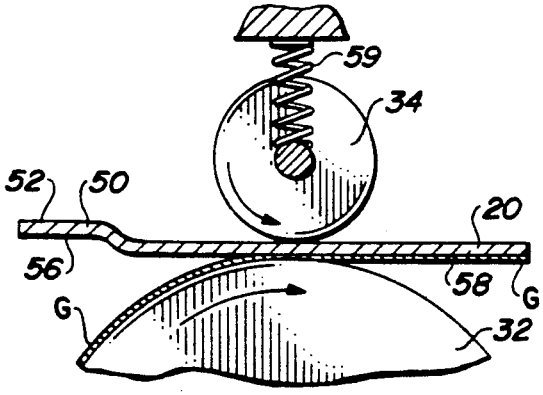
FIG. 4A is an enlarged partial sectional view of the glue station, taken along line 4—4 of FIG. 2, showing the glue wheel contacting an intermediate portion of a glue flap.
Figure 4B:
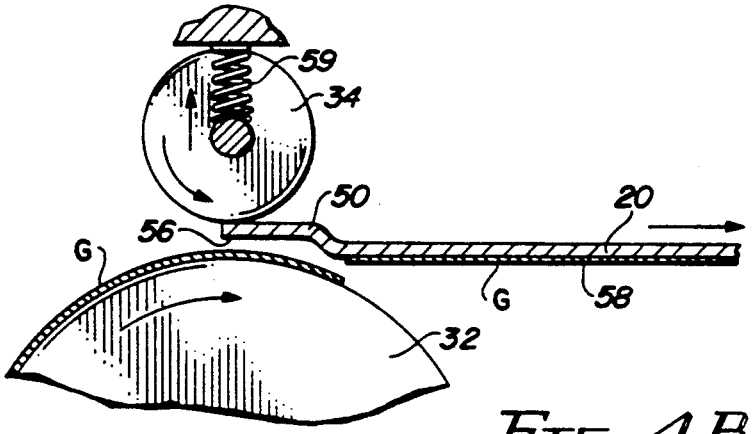
FIG. 4B is an enlarged partial sectional view similar to that of FIG. 4A, but showing the glue wheel contacting the trailing edge portion of the glue flap.

The passage of the glue flap of the blank through the glue station is illustrated in FIGS. 4A and 4B. As shown in FIG. 4A, the spring 59 biases the back-up wheel 34 against the flap 20, forcing the underside of the flap into contact with the glue wheel 32. As a result, glue G picked up by the glue wheel from the reservoir 36 is transferred to the underside 58 of the flap 20 in the form of a layer. When the embossed portion 50 reaches the back-up wheel 34, however, the leading portion of the embossment pushes the back-up wheel upwardly against the force of the spring 58. When this occurs the back-up wheel no longer presses the glue flap against the glue wheel, with the result that the glue wheel no longer contacts the lower surface of the flap and does not transfer glue to it. Because the speed of the moving carton blank is so fast, by the time the spring 58 pushes the back-up wheel down to its normal operating position the trailing edge of the glue flap will have moved past the glue wheel, and the portion of the glue flap between the leading boundary of the recess and the trailing edge of the flap and will not have received any glue. It can be seen that the protrusion has to be near the trailing edge of the glue flap in order for the trailing edge to have time to move past the glue wheel before the back-up wheel returns to its operative position. This arrangement also assures that a sufficient portion of the length of the glue flap receives glue so as to adequately secure the glue flap to the opposite end panel of the blank.

Figure 5:
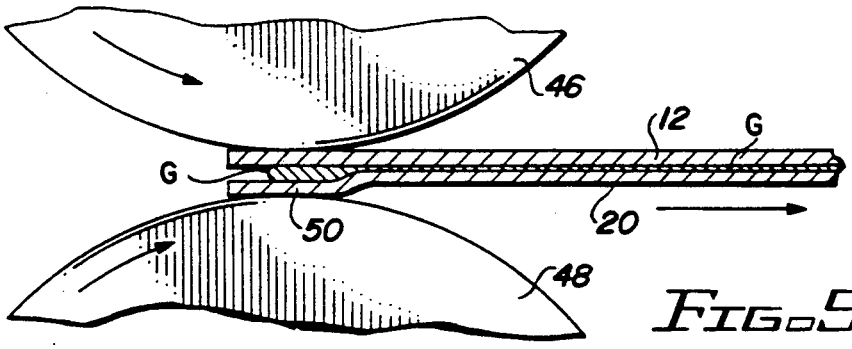
FIG. 5 is an enlarged partial sectional view of the glue flap and adhered panel in the press roll station, taken along line 5—5 of FIG. 2, illustrating the effect of the glue flap design of the embodiment of FIG. 3.

As shown in FIG. 2, after the glue flap and attached panel 14 have been folded over and the end portion of the end panel 12 has been folded over into overlying relationship, the blank passes through the bonding station 49. As further illustrated in FIG. 5, the combined glue flap 20 and panel 12 thus pass between the pressure rolls 46 and 48 which apply sufficient pressure to cause the glue G to bond to the surfaces of the glue flap 20 and panel 12. As the blank continues to move through the bonding station, the pressure rolls tend to squeeze any excess glue which may have been applied toward the trailing edges of the glue flap and panel. In conventional processes, such glue can be present in enough quantity to be forced from between the glue flap and panel, spilling over onto other adjacent portions of the blank. As can be seen in FIG. 5, however, due to the gluing operation described above the trailing edge portion of the glue flap does not receive glue from the glue wheel 32, thus providing no glue to be squeezed out of this area at the bonding station. Further, the larger gap between the glue flap and the panel 12 in the trailing edge portion resulting from the embossed portion of the glue flap provides additional space for receiving glue squeezed from the downstream portion of the assembly. Thus the simple expedient of embossing the trailing portion of the glue flap prevents glue from being applied to the troublesome trailing area of the glue flap, and also accommodates glue which may otherwise have been squeezed into that area.

Figure 6:
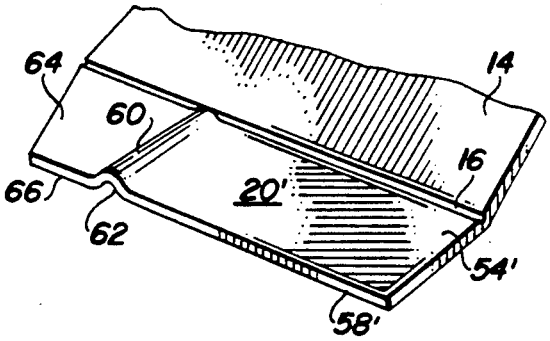
FIG. 6 is a partial pictorial view similar to that of FIG. 3, but showing another form of the invention.

Referring now to FIG. 6, which shows another embodiment of the invention, the glue flap 20′ is embossed in the form of a ridge 60 in the upper face of the flap, which forms a corresponding channel 62 in the lower face of the flap. The flap downstream from the embossment is similar to the flap upstream from the embossment, in that the upper face 64 is at the same level as the upper face 54′ and the lower surface 66 is at the same level as the lower face 58′.

Figure 7A:
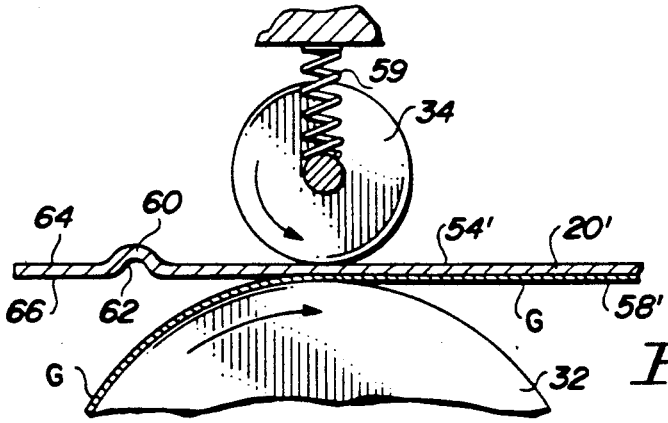
FIG. 7A is an enlarged side elevation similar to that of FIG. 4A, but shown in connection with the embodiment of FIG. 6.
Figure 7B:
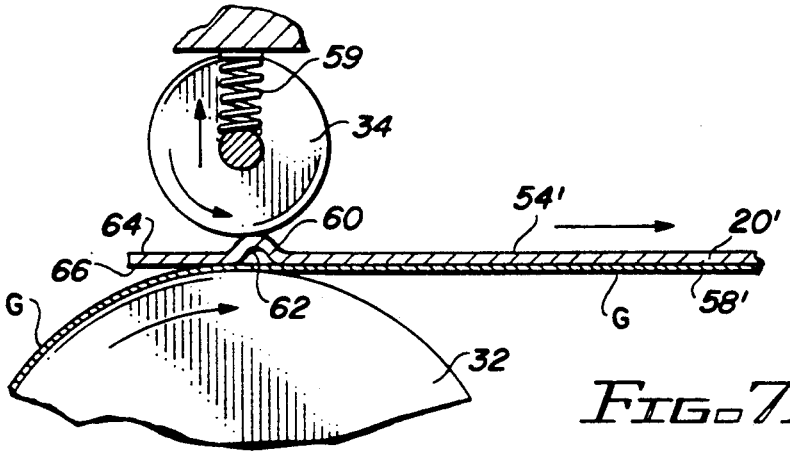
FIG. 7B is an enlarged side elevation similar to that of FIG. 4B, but shown in connection with the embodiment of FIG. 6.

Referring to FIGS. 7A and 7B, when the glue flap 20′ passes through the glue station, glue G is applied by the glue wheel 32 to the underside 58′ of the flap until the ridge contacts the back-up wheel 34 and pushes it upwardly against the force of the spring 58. As in the case of the first embodiment, when this occurs the back-up wheel no longer presses the glue flap against the glue wheel, with the result that the glue wheel no longer contacts the lower surface of the flap and does not transfer glue to it. By the time the spring 58 pushes the back-up wheel down to its normal operating position the trailing edge of the glue flap will have moved past the glue wheel, and the portion of the glue flap between the channel 62 and the trailing edge of the flap will not have received any glue. As in the first embodiment, the protrusion is near the trailing edge of the glue flap, enabling the trailing edge to move past the glue wheel before the back-up wheel returns to its operative position.

Figure 8:
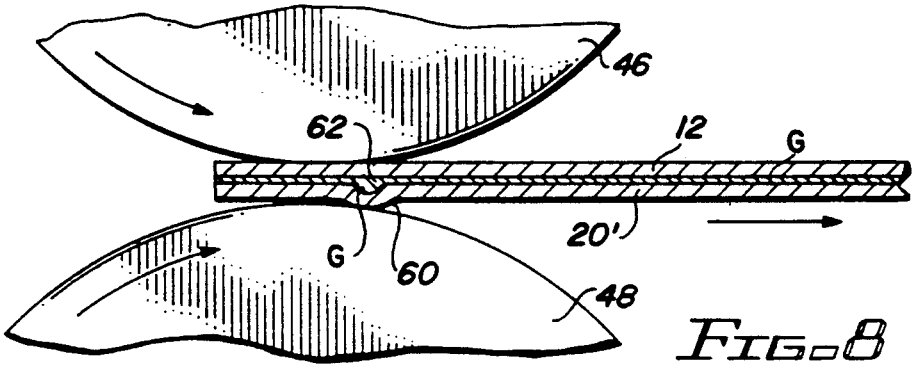
FIG. 8 is an enlarged partial sectional view of the press roll section similar to that of FIG. 5, but illustrating the effect of the glue flap design of the embodiment of FIG. 6.

FIG. 8 shows the glue flap 20 and overlying panel 12 as they are passing through the pressure rolls 46 and 48 in the same manner as shown in FIG. 5. Because there is no glue in the area from the cavity 62 to the trailing edge of the glue flap, the glue flap 20' and the overlying panel 12 would not normally be adhered in this area. If too much adhesive has been applied to the leading portion of the glue flap, however, the excess glue would normally be squeezed into the trailing portion and possibly out onto adjoining surfaces of the carton blank. In this case, the likelihood of excess glue having been applied is small due to the automatic discontinuance of glue application in the trailing portion of the glue flap as a result of the function of the ridge 60. Moreover, the channel 62 would receive any excess glue which may have been applied and squeezed out in the bonding station.

It should now be apparent that the invention provides a simple yet highly effective method for preventing excess glue from being squeezed from between the glue flap and the panel edge to which it has been adhered, thereby preventing subsequent problems of opening the collapsed carton blanks so produced.

It will be understood that the thickness of the glue flap and panels has been made greater than actual size in the drawings in order to better illustrate the invention, and that the actual height of the protrusions and the depth of the associated recesses would be quite small The principles illustrated and described, however, are accurate regardless of the thickness of the material of the blank.

It should also be apparent that the invention is not limited to all the specific features described in connection with the preferred embodiments, but that changes which do not alter the overall function and concept of the invention may be made without departing from the spirit and scope of the invention, as defined in the claims.

What is claimed is:

1. A carton blank, comprising:

a plurality of connected panel sections including at least one interior panel section and opposite end panel sections;

each panel section being connected to an adjacent panel section by a fold line;

a glue flap connected to one of the end panel sections by a fold line and being adapted to be glued to the other end panel section;

the glue flap comprising a first face adapted to receive glue from a glue wheel, an opposite face, a first edge adapted to be the leading edge of the flap as the blank moves through a carton blank folding machine and an opposite edge adapted to be the trailing edge of the flap; and means on the glue flap for preventing application of excess glue thereto, said means comprising a protrusion on said opposite face of the glue flap and a corresponding recess in said first face thereof, the protrusion and recess being located near the trailing edge of the glue flap.

2. The carton blank of claim 1, wherein the protrusion and recess of the glue flap encompass the trailing edge of the glue flap.

3. The carton blank of claim 1, wherein the recess in the first face of the glue flap comprises a channel extending laterally of the fold line connecting the glue flap to the adjacent panel section.

4. The carton blank of claim 1, wherein the protrusion and recess extend laterally of the fold line connecting the glue flap to the adjacent panel section substantially from said fold line to the free edge of the glue flap.

* * * * *